United States Patent [19]

Imamura et al.

[11] Patent Number: 4,473,483

[45] Date of Patent: Sep. 25, 1984

[54] MAGNETIC TONER AND INK

[75] Inventors: Kenji Imamura; Yoshinori Kurosawa; Motohiko Makino, all of Tokyo, Japan

[73] Assignees: TDK Electronics Co., Ltd.; Canon Kabushiki Kaisha, both of Tokyo, Japan

[21] Appl. No.: 329,440

[22] Filed: Dec. 10, 1981

Related U.S. Application Data

[63] Continuation of Ser. No. 104,453, Dec. 17, 1979, abandoned.

[30] Foreign Application Priority Data

Dec. 21, 1978 [JP] Japan ..... 53-160449

[51] Int. Cl.[3] ..... H01F 1/26

[52] U.S. Cl. ..... 252/62.54; 252/62.51; 252/62.53; 430/107; 430/109; 430/111; 430/137; 430/903; 430/904

[58] Field of Search ..... 252/62.5 R, 62.54

[56] References Cited

U.S. PATENT DOCUMENTS

| | | | |
|---|---|---|---|
| 3,471,415 | 10/1969 | Friedman et al. | 252/62.54 X |
| 4,002,804 | 1/1977 | Akashi et al. | 428/539 |
| 4,108,786 | 8/1978 | Takayama et al. | 252/62.1 P |
| 4,154,895 | 5/1979 | Ogawa et al. | 428/425 |
| 4,282,302 | 8/1981 | Makino et al. | 430/107 |

*Primary Examiner*—Arthur P. Demers

*Attorney, Agent, or Firm*—Oblon, Fisher, Spivak, McClelland & Maier

[57] ABSTRACT

A magnetic toner or ink is used in an electrophotography. It comprises a resinous component and a magnetic having a spinel structure and having the formula $$M_{\frac{1-x}{1+x}(1-y)}Fe_{\frac{2x}{1+x}(1-y)}O_y$$

wherein M represents at least one of Mn, Ni, Co, Mg, Cu, Zn or Cd; and x is in a range of 0.5 to 1 and y is in a range of 0.1 to 0.571.

8 Claims, No Drawings

MAGNETIC TONER AND INK

This is a continuation, of application Ser. No. 104,453, filed Dec. 17, 1979, now abandoned.

BACKGROUND OF THE INVENTION

1. Field of the Invention

The invention relates to a magnetic toner or ink and a process for producing the same. More particularly, the invention relates to a magnetic powder with a high degree of black, and good electric and magnetic characteristics which is suitable particularly for a magnetic toner used in electrophotography and a process for producing the magnetic powder.

2. Description of the Prior Arts

One component system developer called a magnetic toner has been known as a developer used in electrophotography. The magnetic toner contains magnetic powder of black color. The use of the black magnetic powder enables one toner to serve as both carrier and toner if the development of a dry type copying machine, thereby to eliminate the need for the carrier in practical use of the developer. Therefore, and operation of a development is easily carried out and accordingly, no control is acquired and an exchange of a carrier is not required and only additional feeding of the toner is required. Moreover, a development unit is simple whereby a labour required for a maintenance is highly reduced and an apparatus is simplified to result in light weight and low cost. Because of those beneficial features, the study of the magnetic toner has been actively conducted recently and some products, developed as a result of the study, have been employed in a commercial scale.

It has been used in the black magnetic powder for the magnetic toner, a magnetite as iron black used for a black pigment which is obtained as a precipitate in a reaction of an aqueous solution (hereinafter referring to as an aqueous solution process). It has been proposed to use various metal oxides, alloys and the like for the black magnetic powder for the magnetic toner. Those materials, when used for it, are attended with many disadvantages. Only the magnetite, therefore, has been practically used eventually. The magnetite powder produced by a wet process using the aqueous solution process has the following various defects or points to be improved, however. When the magnetite is used for the magnetic toner, the toner using it therefore has unsatisfactory characteristics, with the result that one encounters various problems in the use of the toner and meets troubles in a particular copying process because of said advantages.

The magnetite powder produced by the wet process necessarily experiences the aqueous solution process in the course of the production. The magnetic powder thus produced is poor in the heat resistance and the moisture resistance. Usually, the toner is used at about 150° C. At such a temperature, the hue of the powder, the maximum magnetization $\sigma$ m, the coercive force, the electric resistance, charging amount and the like change, so that the color of the toner and the electric and magnetic characteristics are thermally changed. Further, the magnetite powder has a high hygroscopic property and accordingly, the electrostatic characteristic of the toner is influenced by moisture. In the aqueous solution process, since a large amount of an alkali is used, the residual alkali is contained in the powder even after a washing is carefully performed. The residual alkali considerably deteriorates electrostatic characteristics of the toner resinous component mixed with the residual alkali, adversely changes the quality of the resinous component, or facilitates the aging of the characteristics of the toner. In the wet process, there are many fluctural factors of the process condition for each lot, such as an atmosphere in contact with the solution, an amount of oxygen contained in the solution, the washing conditions, so as to greatly vary the electric and magnetic characteristics, the heat resistance, the moisture resistance, the particle diameter, the particle size distribution and the impurity content. When the powder is used for the magnetic toner, the height of the magnetic brush determined by the magnetic characteristic of the powder, and carrying, the fluidity and the cohesion of the toner vary for each lot. The electrostatic characteristic also varies and hence the picture quality changes. The hue, the heat resistance, the moisture resistance, the compatibility of the powder with the resinous component, a rate of the aging of the resinous component vary, too. Additionally, in the wet process, it is difficult to accurately control the process conditions; the alkali washing is not easy; and a labour is required for a treatment of a waste solution after the washing to increase a cost for the production.

The magnetite produced by the wet process has satisfactory electric and magnetic characteristics and good hue, when it is produced by using much of the labour and under good production. Those characteristics still have some problems to be solved, however. One of those problematic points is to further improve a degree of black. The improvement is desirable, particularly, when it is used for the magnetic toner. Another is to improve the electrostatic characteristic, particularly, the charging amount of the powder. The improvement of this eliminates a variation of the transfer density caused by the resistance variation of a transfer paper which is caused by a moisture variation, and improves the resolution and the graduation, resulting in the improvement of the picture quality. In this respect, it is desired to increase the charging amount of the powder. Still another is to increase a maximum magnetization $\sigma$ m ranging 50 to 65 emu/g in an external magnetic field of 1000 Oe. With the increase of the maximum magnetization $\sigma$ m, the height of the magnetic brush is improved. This improvement is desirable.

For overcoming those disadvantages of the magnetite powder for the magnetic toner produced by the conventional wet process, the inventors proposed that the magnetite powder produced by the dry process is more preferable for the magnetic toner than that by the wet process. In the dry process, iron oxide is sintered at 1300°-1500° C. and then, the sintered one is pulverized. The magnetite powder thus produced is satisfactorily stable in the hue, and the electric and magnetic characteristics at the temperature up to about 180° C., good in the heat resistance, small in the humidity absorption, and good in the moisture resistance. With an average particular diameter of less than 1$\mu$, the paricle size, the particle diameter distribution, and the surface condition of the magnetite powder are stable. The magnetic powder has a good compatibility with a resinous component, and it has high affinity to the resinous component. Further, the magnetic powder is free from such disadvantages as the magnetite obtained by the conventional aqueous solution process which contains an alkaline component remained in the production which causes disadvantageous effects to the resinous component whereby the electrostatics of the magnetic toner are varied. Further, it is free from the disadvantage that there is a variation in the electric and magnetic characteristics, the heat resistance, the moisture resistance, the compatibility of it with the resinous component, and the like.

The magnetite powder prepared by the dry process has the same composition as that of the magnetite powder produced by the wet process. Accordingly, the hue, and the electric and magnetic characteristics are comparable between them. As in the previous case, it is desired to improve the degree of black and, in particular, the charging amount and the maximum magnetization $\sigma$ m.

The inventors also proposed an excess iron component type ferrite powder having spinel structure, as suitable for the magnetic toner, which comprises components of iron oxide having a ratio of 99.9 to 51 mole % as $Fe_2O_3$ and at least one metal oxide selected from the group consisting of manganese oxide, nickel oxide, cobalt oxide, magnesium oxide, copper oxide, zinc oxide, and cadmium oxide at a ratio of 0.1 to 49 mole % as M'O (M' represents Mn, Ni, Co, Mg, Cu, Zn or Cd). The ferrite having the spinel structure is given by $$(MO)_z(FeO)_{1-z}Fe_2O_3$$

wherein z is in a range of 0.002 to 0.980 and MO represents one to six kinds of said M'O as one mole. The amount of the oxygen contained is substantially the same as that of the stoichiometric composite. Like the magnetite powder by the dry process, the ferrite powder having the spinel structure is good in the heat resistance, the moisture resistance, and the mixture of it with the resinous component, and does not adversely affect the resinous component. Further, the electric and magnetic characteristics, the heat resistance, the moisture resistance and the mixture of it with the resinous component do not vary for each batch in the production. The electric and magnetic characteristics of the excess iron component type ferrite powder are comparable with those of the magnetite powder. In the group of the ferrite powder, some powders with specific composition has the much better magnetic characteristic, compared to that of the magnetite powder.

The cobalt ferrite and the complex cobalt ferrite in the group of the ferrites have the degree of black as high as that of the magnetite. However, the remaining ferrites are relatively reddish and accordingly, those must be improved in the degree of black. Further for the ferrite having the spinel structure, it is desirable to improve particularly, the maximum magnetization $\sigma$ m and the charging amount as well so as to improe the spike of the magnetic brush and the picture quality when it is used for the magnetic toner.

The description of the magnetic powder for the magnetic toner having heretofore described may be correspondingly applied to the magnetic powder for the magnetic ink or the ink jet. The improvement of the degree of black and the magnetic characteristic have been accordingly desired in the field of the magnetic ink or the ink jet.

SUMMARY OF THE INVENTION

It is an object of the present invention to overcome the disadvantages and problems of the conventional magnetic toner or ink which comprises the conventional magnetic powder.

It is another object of the present invention to provide a magnetic toner or ink which has excellent characteristics required for the magnetic toner or ink.

It is the other object of the present invention to provide a process for producing the magnetic toner or ink comprising an improved magnetic powder.

it is further object of the present invention to provide a magnetic powder for a magnetic toner or ink which has high black degree and improved magnetic characteristic, particularly, the maximum magnetization.

It is the other object of the present invention is to provide a magnetic powder for the magnetic toner or ink which has improved charging amount and good electrostatic characteristic, and good picture quality particularly when it is applied for the magnetic toner in addition to the above object.

It is the further object of the present invention to provide a magnetic powder for toner or ink which has good heat resistivity, moisture resistivity and the compatibility with resinous component, and without any adverse affect onto the resinous component, and further exhibiting good characteristics particularly when it is applied for the magnetic toner, in addition to the above object.

The other object of the present invention is to provide a process for producing the magnetic powder for toner or ink with excellent characteristics as mentioned above.

The other object of the present invention is to provide a process for producing the magnetic powder for toner or ink of which the electric and magnetic characteristics, hue, heat and moisture resistances, particle size distribution, surface condition and the like are not varied for each batch in the production, by accurately controlling those factors, and which the process is useful when the magnetic toner is applied for the magnetic toner.

Other objects and features of the present invention will be apparent from the following description.

The foregoing and other objects of the present invention have been attained by providing a magnetic toner or ink comprising a magnetic powder having the formula $$M_{\frac{1-x}{1+x}(1-y)}Fe_{\frac{2x}{1+x}(1-y)}O_y$$

wherein M represents one or more atom selected from the group consisting of Mn, Ni, Co, Mg, Cu, Zn and Cd; x is in a range of 0.5 to 1 and y is in a range of 0.1 to 0.571.

DETAILED DESCRIPTION OF THE PREFERRED EMBODIMENTS

The inventors have studied various problems so as to attain said purposes.

In order to obtain an evaluation of excellent degree of black, an absolute value of a reflectivity in a specturm of reflection should be less than several percent especially less than 5% as a practical luminosity and a difference of reflectivities in different wavelengths of the spectrum is substantially small to be flat reflective spectrum. Thus, excellent degree of black can be given to minimize difference between the reflectivities of blue and red of the magnetic powder and to minimize the absolute reflectivities.

On the other hand, in the magnetite or the excess iron component type ferrite powder applied for the toner or ink, the particle diameter of less than 1μ makes small absolute value of the reflectivity of the magnetic powder, but it makes large reflectivity in red in the reflective spectrum. This arises from the fact that, because of much finer pulverization of the magnetic powder, the spectral characteristic of the material is revealed. It was further found that the excess iron component type ferrite powder or the magnetite powder frequently contains an appreciable amount of $\gamma$-$Fe_2O_3$ and the presence of $\gamma$-$Fe_2O_3$ prevent to form flat reflective spectrum.

On this finding, the inventors estimated that, if a trace of the $\gamma$-$Fe_2O_3$, which might be contained in the magnetic powder is removed from the magnetic powder, the blackness of the magnetic powder might be improved. On this estimation, the magnetic powder is subjected to the treatment of reduction. The result of the X-ray or electron-ray analysis on the reduced magnetic powder showed that $\gamma$-$Fe_2O_3$ or $\alpha$-$Fe_2O_3$ is not present in the powder.

Higher degree of black is given for the magnetic powder containing $\alpha$-Fe which includes an oxygen content less than the stoichiometric amount which is obtained by certain reduction from the magnetic powder having a stoichiometric oxygen content in the chemical analysis. Moreover, magnetic characteristic particularly, the maximum magnetization $\sigma$ m is improved and the height of the magnetic brush is improved when it is used for the magnetic toner and the charge is increased and the picture quality is improved when it is used for the magnetic toner. Such phenomenon has been always found in the case of less oxygen content type structure comparing to the magnetite or the iron excess type ferrite which is obtained by a reduction of the magnetite or the iron excess type ferrite having stoichiometric oxygen content.

The present invention has been attained by the unthinkable findings.

The magnetic toner or ink of the present invention will be described.

The magnetic toner or ink comprises a magnetic powder having the formula $$M_{\frac{1-x}{1+x}(1-y)}Fe_{\frac{2x}{1+x}(1-y)}O_y \quad \text{I}$$

wherein M represents one or more atom selected from the group consisting of Mn, Ni, Co, Mg, Cu, Zn and Cd; x is in a range of 0.5 to 1 and y is in a range of 0.1 to 0.571.

As described below, the magnetic powder having the formula I can be obtained by reducing the corresponding ferrite powder or the iron oxide powder.

In the formula, when the ratio of M:Fe in the corresponding ferrite powder or the iron oxide powder which will be reduced, is calculated as MO:$Fe_2O_3$, the ratio of Fe as $Fe_2O_3$ in the ferrite powder or the iron oxide powder is given as x in the formula I. On the other hand, y is a ratio of the oxygen atom in the magnetic powder. Thus, in the formula I, when y is 0.5714, it is the magnetite in the case of $x=1$ and it is the excess iron type ferrite in the case of $1>x>0.5$ and it is equimole type ferrite in the case of $x=0.5$. The formula shows the spinel type ferrites. Thus, the magnetic powder having the formula I is the less oxygen content type iron oxide comparing to the stoichiometric one. The preferable material for the magnetic powder is the one having the spinel structure proper to the ferrite group including the magnetite, or the excess iron component type or the equimole type ferrite which can be confirmed by the X-ray or the electron-ray analysis, and having $\alpha$-Fe which can also be confirmed by the same method. The magnetic powder of the present invention can include less than 1.0 wt. % of impurities such as $Al_2O_3$, $Ga_2O_3$, $Cr_2O_3$, $V_2O_5$, $GeO_2$, $SnO_2$, $TiO_2$, etc. The magnetic powder can contain also a surface modifier added in the production if desired. The magnetic powder of the present invention has an average particle diameter of less than about 1μ and preferably in a range of about 0.02 to 0.8μ for the magnetic toner, and further has sharp particle size distribution by a preferable process for producing the magnetic powder.

As will be apparent from examples to be described below, the magnetic powder according to the invention has the absolute value of the reflectivity of less than 5%, the flat reflective spectrum of the powder, and high degree of black. Additionally, the magnetic powder has a fairly high maximum magnetization $\sigma$m and accordingly, is suitable for toner or ink, particularly for the magnetic toner. Moreover, the electric resistivity is satisfactory as, $10^5$ to $10^7$ Ω.cm and is preferable for the magnetic toner. After it is heated at about less than 180° C., the electric and magnetic characteristics and the hue of the magnetic powder is slightly deteriorated. Accordingly, the heat resistance is extremely high and the moisture resistance is good. Further, in its application for the magnetic toner, the compatibility with the resinous component is good and no adverse effect is given to the resinous component.

As described above, the magnetic powder having the formula I according to the invention is very useful when used for the toner or ink. Whether it has the formula I or not may be confirmed by the following measurement.

Firstly, the magnetic powder is placed in a proper atmosphere to be for its oxidation. Preferably, it is heated at 700° C. for five hours in atmosphere. In this case, if the x in the formula I, that is, the ratio of 2Fe to M (same as the above-mentioned one) in the magnetic powder, and the composite ratio of components M (if M includes two or more components) are not accurately learned from the starting material, those must be checked before the oxidation treatment. Further, in the oxidation treatment, the water content in the magnetic powder must be previously measured to learn the true weight of the magnetic powder. In case where much of impurities is contained in the magnetic powder, the composition ratio of the metal elements as the impurities must be checked. In the oxidation treatment performed, following this, under conditions of 700° C., atmosphere, 5 hours as mentioned above, Fe in the powder is oxided into $Fe_2O_3$; Mn contained as M into $Mn_2O_3$; the metal other than Mn contained in M maintains a state of divalent oxide MO: the usual metal oxidation as the impurity maintains its oxided state; the sublimation of various metal oxide is negligible. Accordingly, y in the formula I may readily be obtained in the following manners. The weights of the powder and the water contents before and after the oxidation are measured. Then, the true weights of the magnetic powder before and after the oxidation are obtained by subtracting the water contents from the net weights of the magnetic powder, respectively. On the basis of the true weights obtained, a true change of the magnetic powder weight caused by the oxidation is obtained. And finally, an increase of the oxygen content after the oxidation is obtained by referring to the composition ratio of the metal components in the magnetic powder, such as Fe and M, which is known or previously obtained. The results of such measurements conducted on the magnetite powder and the excess iron component ferrite powder, showed that y is greater than or equal to 0.5714.

The effects of the invention may also be attained when the magnetic powder having the formula I is an oxide with insufficient amount of oxygen corresponding to the magnetite with x of 1. The magnetic powder according to the invention be an oxide with an insufficient amount of oxide corresponding to the excess iron component type or the equimole type ferrite with x of less than 1 in the formula I. In this case, the better hue, and better electric and magnetic characteristics are ensured when $0.51 \leqq x < 1.0$ (particularly 0.98 or less), and M includes at least one of the components Co, Mn, Sn, Ni and Mg as an essential component and additionally one to two components of Cu and Cd. A more signficant effect is attained when x ranges from 0.55 to 0.90, particularly 0.55 to 0.85. In such a case, M is preferably one component system of Zn, Co, Ni, Mg or Mn; two component system of Zn-Co, Mn-Co, Ni-Zn, Ni-Co, Zn-Mg, Co-Mg or Mn-Zn; three component system of Co-Zn-Cu, Ni-Co-Zn, Ni-Zn-Cu, Mn-Zn-Cu, or Co-Zn-Mg; four component system of Co-Mn-Zn-Ni.

When x is less than 1, M is preferably given by the following formulae II to V $$M^{(1)} \quad \text{(II)}$$

wherein $M^{(1)}$ represents Mn, Zn, Ni, Co or Mg, preferably Mn, Zn, Ni or especially Mn, Zn or Ni.

$$M^{(2)}_aZn_{1-a} \quad \text{(III)}$$

wherein $M^{(2)}$ represents Ni, Co or Mg, preferably Mn, Ni or Co and a represents 0.01 to 0.95, preferably 0.05 to 0.7.

$$M^{(3)}_bCo_{1-b} \quad \text{(IV)}$$

wherein $M^{(3)}$ represents Mn, Ni or Mg, preferably Mn or Ni, and b represents 0.01 to 0.95, preferably 0.05 to 0.95.

$$M^{(4)}_cCo_dZn_{1-c-d} \quad \text{(V)}$$

wherein $M^{(4)}$ represents Mn, Ni or Mg, preferably Mn or Ni and c ranges 0.05 to 0.75 and d ranges 0.05 to 0.75 and the sum of c and d is 0.5 or more, but less than 1.

In either case of x is 1 or less than 1, when y is in a range of 0.1 to 0.571, the effect of the present invention can be attained and when y is in a range of 0.3570 to 0.5710 especially 0.3570 to 0.5700, the optimum hue, charge and maximum magnetization can be attained.

The optimum range of y is not different regardless of the value of x and the kind of M.

The magnetic powder for toner or ink is manufactured by reducing the corresponding ferrite powder or iron oxide powder in a reduction atmosphere.

The powder to be subjective to the reduction may be various oxides of $M_{1-x}Fe_{2x}$ (M and x are defined above), such as the magnetite corresponding to the formula I, the ferrite powder included in the group of the spinel type ferrites consisting of the excess iron component type and the equimole type ferrites, and various iron oxides. In this case, when various iron oxides such as $\alpha$-$Fe_2O_3$ and $\gamma$-$Fe_2O_3$ or the magnetite produced by the dry or the wet process are used for the reduction, the powder of insufficient oxide corresponding to the magnetite of $x=1$ in the formula I is obtained. For the reduction, it is used the equimole or excess iron component ferrite powder substantially given by the formula $$(MO)_{z'}(FeO)_{1-z'}Fe_2O_3$$

where M is defined above, and z' is 0 to 1, preferably 0.002 to 0.980.

The reduction provides the oxide powder with insufficient oxygen corresponding to the equimole type or the excess iron component type ferrite of $0.5 \leqq x < 1$ in the formula I.

The reduction is usually carried out by heating it in an atmosphere. The temperature of the heating is less than 600° C., preferably 250° C. to 550° C. Although depending on the temperature of heating or other atmospheric condition, the heating time usually 0.5 to 10 hours, preferably 1 to 5 hours. The heating time for obtaining the composition by the formula I can be previously decided by experiments thereof. The reducible atmosphere may be the one to remove oxygen from the iron oxide or the ferrite powder in the temperature range, or the reducible atmosphere usually used in the baking of the powder, such as the mixed air of $H_2$, CO, $H_2$ and CO. In addition to the mixed gas, the reducing gas may be a petroleum gas such as methane, ethane, propane, butane, etc., particularly lower alkane or the like, or ammonium in the form of cracked gas atmosphere. In this case, those reducing gas may be mixed one another in use or with an inert gas such as nitrogen and argon with the concentration of more than 5%. A furnace may be filled with the reducing gas or the mixed gas for the reducible atmosphere. It is preferable to flow the reducing gas or the mixed gas into the furnace at a desired flow rate, usually 10 to 1000 liter/hr., preferably 50 to 800 liter/hr, for each processing amount of 1 kg. From the viewpoint of the ability of the reduction process, it is preferable to use hydrogen or lower alkane as the reducing gas. In the use of hydrogen, the powder of about 1 kg is processed at the flow rate of 50 to 1000 liter/hr for 1 to 3 hours at temperature 300° to 480° C., to give the formula I. In the use of the lower alkane, the process is carried out at the flow rate 50 to 800 liter/hr, for 1 to 3 hours at the temperature 400° to 550° C. The relation between those reduction conditions and the compositions may be previously obtained in experiment by conducting the measurement through the oxidation, in an easy manner.

On this manner, the iron oxide or the ferrite powder is subjected to the reduction and then, it is mechanically pulverized or ground, if necessary, to obtain the magnetic powder for toner or ink.

A process for producing the magnetic powder of the invention will be described on the basis of the most preferable embodiments thereof. The process for producing the magnetic powder can be modified to give different embodiments depending on if the magnetic powder M or not for the respective cases where $x=1$, $x<1$ and $x \geqq 0.5$ in the formula I. The respective embodiments will be described individually.

A first embodiment in which x is less than 1 and the magnetic powder includes M (defined above) will be described.

In this case, the ferrite powder having the spinel structure substantially given by the following formula is firstly prepared:

$$(MO)_{z'}(FeO)_{1-z'}Fe_2O_3$$

where M and z' are defined above. The ferrite powder of the present invention can be produced by the following process as one preferable embodiment.

In the first step of the production, the starting materials are mixed.

The starting materials can be $Fe_2O_3$ at a ratio of 99.9 to 51 mole % and one ore more of MO (M is defined above) at a total ratio of 0.1 to 49 mole %. It is possible to use one or more of Fe, FeO and $Fe_2O_3$ at a ratio of 99.9 to 51 mole % as $Fe_2O_3$ instead of $Fe_2O_3$ itself. It is possible to use the other oxide of M or a compound which is convertible into MO by a heating such as carbonates, oxalates, chlorides of M etc., instead of MO. The starting materials at desired ratios are mixed. A wet mixing process is preferably employed, and can be the conventional wet mixing process. In usual, the starting materials are mixed in a wet ball mill for several hours such as about 5 hours. The uniformity of the starting materials is improved by the wet mixing process to decrease causes for fluctuation of the structure and flucturation of characteristics is remarkably small. The ferrite powder has remarkably excellent characteristics as the magnetic powder for toner. Following this, the resulting slurry is subjected to a granulation step. Before the granulation step, the slurry may be dried to have less than 10% of a water content, if necessary. After dried, the slurry as it stands or the one processed to have a solid proper shape, although it depends on the nature of this starting materials, is previously calcined at a temperature of lower than 1000° C. such as 800° to 1000° C. for one to three hours. The calcined product is crushed to have granules with particle size of several tens micrometer or less. If this step is employed, the following step for granulation may be omitted. The granulation step follows. This step processes the mixed starting materials into granules of 20 to 30 mesh or less. The granules may be formed by making the mixed materials dried to pass through a sieve or by subjecting the wet mixed slurry to the spray dry process.

Then, calcining step follows. In the sintering, it is preferable to sinter the granular powder. If necessary, the granular powder is compressed to form a solid having a desired shape, or the slurry obtained by adding water to the granular powder is molded or extrusion molded to form the same. The sintering is carried out in a furnace at a desired temperature of higher than 1000° C. In this case, the preferable sintering temperature is a controlled, to the temperature within a range 1300° C. to 1450° C. and the sintering time is one to 10 hours, preferably 3 to 5 hours. The heating velocity to reach the sintering temperature is at a rate of 50° C./hr. or more, preferably 100° to 200° C./hr. Various types of heating methods can be employed for the sintering. After the temperature maintaining for a desired period, the furnace is cooled. Various cooling methods can be employed for the cooling. The cooling velocity is 100° C./hr, preferably 300° C./hr. or more. The sintering can be carried out by a sequential process with a profile consisting of the temperature rise, the temperature keeping and the temperature fall. The following atmosphere is preferable for the sintering. It is possible to sinter in air in the furnace. In the case of the sintering in air, the cooling velocity must be greater than 500° C./sec. To realize this, the related apparatus is complicated and its handling is also difficult. Therefore, in the temperature keeping and the cooling in the furnace, particularly the cooling, it is preferable to set the oxygen partial pressure in the furnace lower than that of the atmosphere. If it so done, the ferrite with the composition approximate to the stoichiometric one can be obtained to stabilize the composition of the ferrite powder. The oxygen partial pressure is so adjusted as to provide 5 vol. %, preferably 3 vol. % or less, of the oxygen content in the furnace, during the cooling period from a time point that the furnace is cooled from the temperature at the cooling initiation to about 1100° C., until it is cooled to about 200° C., preferably during the period that the sintering temperature is kept stably and the period that the furnace temperature is cooled from the temperature at the cooling initiation to about 200° C. In this case, during the period for stably keeping the sintering temperature, the oxygen content is 5 vol. % or less preferably it is 0.5 vol. % or less, particularly 0.1 vol. % or less during the time period from an instant that the furnace temperature rises to 800° to 900° C. till the temperature keeping terminates. More preferably, it is kept at 0.1 vol. % during the period from the time point that the temperature keeping terminates and the heating ceases till the furnace temperature falls below 100° C. or less, in the cooling. In the cooling at the cooling velocity of 500° C./hr. or more, a fixed oxygen content of 0.1 vol. % or less is held till the temperature falls below 100° C. In the cooling at the cooling speed of less than the above, the oxygen content is preferably controlled to be 0.1 vol. % or less until the temperature at the cooling initiation falls below about 1100° C., and to be 0.05 vol. % till the temperature further falls below 100° C. Such a control of an oxygen partial pressure may reading be performed in the known method. Through the profile consisting of the heating, the cooling and the oxygen partial pressure control, the sintering is completed and, when the furnace temperature falls below 100° C., the sintered product is taken out from the furnace.

The sintered product is pulverized to form particles having an average diameter of less than 150 mesh under. The pulverization can be carried out by a vibration mill or an atomizer. When the sintered product is crushed by a jaw crusher or a stamp mill to form rough particles having less than 20 mesh under before the pulverization, the efficiency of the pulverization is superior. The pulverized particles are further ground preferably by a wet method, for example, by a wet atomizer at a concentration of the slurry of less than about 50% for 10 to 100 hours. Thus, the powder having an average particle diameter of 0.2 to 0.8$\mu$ is obtained. The powder is dried at lower than 100° C. to reduce a water content to less than 0.7%. The powder is pulverized into primary particles to obtain the ferrite powder of the present invention. The powder thus obtained is subjected to the reduction as mentioned above. In this case, it is preferable as the above-mentioned case, to granulate the powder before the reduction. This may be realized by processing the slurry by the spray drier or by making the slurry to pass through a sieve after it is dried. The powder may be further ground by an atomizer or the like into primary particles.

The excess iron component type or equimole type ferrite powder having the spinel structure thus obtained is subjected to the reduction. Then, the reduced one is pulverized by the atomizer, for example, into the primary particles with the average particle diameter of 1μ or less, usually 0.2 to 0.8μ in the present invention.

In the preferable embodiment as mentioned above, after the particles of the ferrite powder are produced, those are subjected to the reduction. If necessary, the reduction may be carried out after the sintering of the powder or after the coarse or the medium crush of the sintered product. In this case, the reduced one is mechanically ground or pulverized after the reduction.

The explanation to follow is for the embodiment of the process for producing the magnetic powder according to the invention when x is 1 and M is not included. The object to be reduced is usually the powder of α-$Fe_2O_3$, γ-$Fe_2O_3$ or the magnetite produced by the wet or the dry process. In order to effectively reduce the powder, it is preferable to use the powder with the particle size of 20 mesh under. When the powder has not such a particle size, the powder is granulated or crushed and ground, and finely pulverized, as in the previous case. Following this, the powder thus processed in subjected to the reduction. Then, the reduced one is mechanically pulverized or grounded to have the magnetic powder of the invention. In case where the magnetite produced by the dry process is used, iron oxide, iron or iron compound is used as the material for the magnetite. Those materials or the mixture of those are pulverized and the pulverized one is sintered as in the case of the ferrite having the spinel structure to have the sintered magnetite powder. The sintered magnetite powder is reduced and then mechanically pulverized. Through this process, the magnetic powder of the invention is obtained.

As described above, the process for producing the magnetic powder according to the invention can produce a high quality magnetic powder for toner or ink effectively and inexpensively. Further, the magnetic powder produced is satisfactory in the electric and magnetic characteristics, the hue, the surface condition, the particle diameter, the impurity, contents and the like. Moreover, those characteristics are invariable independently of the lots in the production.

The present invention will be further illustrated by certain examples and references which are provided for purposes of illustration only and are not intended to be limiting the present invention.

EXAMPLE 1

In a wet ball mill, 20 mole % of ZnO and 80 mole % of $Fe_2O_3$ were mixed for 5 hours. The resulting slurry was spraydried to form granules which pass through a sieve of 20 mesh. The granules were sintered in a furnace by heating it at a heating velocity of 200° C./hr and sintering it at 1350° C. for 3 hours and cooling it at a cooling velocity of 300° C./hr. The oxygen partial pressure of the atmosphere was adjusted to give 0.05 vol. % from an instant that the temperature in the furnace rises to 900° C. until the temperature cools down to the room temperature. Then, the sintered product was discharged from the furnace, and crushed by a stamp mill to form particles passing through a sieve of 20 mesh. The crushed one was further pulverized by an atomizer to be particles passing through a 150 mesh sieve. The pulverized product was further ground in the form of the slurry by a wet atomizer. The powder obtained by grinding the slurry was dried and further pulverized by an atomizer to obtain a ferrite powder A'.

The X-ray analysis of the powder A' showed the spinel structure but did not show the presence of α-Fe.

The ferrite powder A' was again put into the furnace and is reduced at 420° C. for one hour while the hydrogen gas and nitrogen gas were supplied to the furnace at the velocities of 600 liter/hr. and 300 liter/hr. The reduced powder was then pulverized into the primary particles thereby to obtain the magnetic powder A1 of the invention. Further, the reduction time was selected to 2, 3 and 4 hours while the other conditions were unchanged. Thus, the magnetic powders A2 to A4 were obtained. The powders A1 to A4 thus obtained were X-ray analyzed so that the spinel structure and the presence of α-Fe were observed.

The oxygen contents of the ferrite powders A', and A1 to A4 were measured in the following manner. The powder was heated in air of the furnace at 700° C. for 5 hours as the oxidation process. Then, the water contents of each powder before and after the oxidation was measured to obtain the real weight change on the basis of the difference between the water contents. The results showed that, when M=Zn and x=0.8, y, i.e. the oxygen atom content of the powders A' and A1 to A4 were 0.5714, 0.5540, 0.5143, 0.3572 and 0.0364, respectively.

Additionally, the reflectivity and the maximum magnetization of each powder were measured. The powder was dropped into the Faraday gauge manufactured by Takeda Riken Co. Ltd. at the rate of 0.1 g/sec. while the powder contacted the wall of a glass funnel. The output of the Faraday gauge was read by a potential meter of vibration type manufactured by the same company to measure the charging amount of the magnetic powder. The results of the measurement was tabulated in Table 1.

TABLE 1

| Powder | Oxygen content y | Reflectivity (%) | Charge $\times 10^{-10}$ (C/g) | Increase of charge (%) | Maximum magnetization at 5000 $O_e$ (emμ/g) |
|---|---|---|---|---|---|
| A' | 0.5715 | 3.9 | 1.07 | — | 78 |
| A1 | 0.5540 | 3.3 | 1.69 | 58 | 88 |
| A2 | 0.5143 | 2.9 | 1.47 | 37 | 91 |
| A3 | 0.3572 | 2.9 | 1.11 | 3 | 103 |
| A4 | 0.0364 | 7.0 | 0.58 | −54 | 140 |

From the table 1, it is found that the magnetic powder having the formula I according to the invention is markedly excellent in the blackness, the charge and the maximum magnetization. Accordingly, it is well adapted for toner or ink, particularly the magnetic toner. The other characteristics such as the electric and magnetic characteristics, the heat resistance, the moisture resistance and the like were empirically proved to be satisfactory to the full, particularly in the magnetic powders A1 to A3.

EXAMPLE 2

Except that 10 mol % of ZnO, 10 mole % of Co and 80% of $Fe_2O_3$ were mixed, the same process as that of Example 1 was carried out to obtain zinc-cobalt ferrite powder B' having the spinel structure and an average particle diameter of 0.45μ.

Then, the powder B' was put into a furnace where it was reduced at 450° C. for one hour while hydrogen gas and nitrogen gas were fed at rates of 600 liter/hr. and 300 liter/hr. into the furnace. After this, the powder was pulverized into the primary particles to thereby otain the magnetic powder B of the invention.

The oxygen content of the powder B was measured in the same conditions as those in Example 1. The result of the measurement showed that y was 0.5531 when M=Zn 0.5 Co 0.5 and x=0.8 in the formula I. In the powder B', y was 0.5714. The X-ray analysis of the powder B indicated the spinel structure of the powder B and the presence of α-Fe in the same.

Measurements of the reflectivity, the charge and the maximum magnetization of the powders B and B' were carried out as in Example 1. As a result, the reflectivity was 3.3% (that of the powder B' was 4.0%), the charge was $1.34\times10^{-10}$ c/g (an increase of the charge wth respect the powder B' was 37%) and the maximum magnetization was increased with respect to the powder B'. The result showed that the powder B was very useful when applied for the magnetic toner, as the overall characteristic.

EXAMPLE 3

Except that $Mn_3O_4$ at a ratio of 20 mole % as MnO and 80 mole % of $Fe_2O_3$ were mixed, the same process as that in Example 1 was carried out to obtain manganese ferrite powder C' having the spinel structure and an average particle diameters of 0.44 μ.

Then, the powder C' was reduced under the same conditions as those in Example 2 and the reduced one was pulverized into the primary particles. In this manner, the magnetic powder C was obtained. The oxygen content measured of the powder C was that y=0.5539 in the formula I when M=Mn and x=0.8, as in Example 1. The spinel structure and the presence of α-Fe were observed in the X-ray analysis rays of the powder C. Further, the reflectivity of the powder was 3.6% (the reflectivity of the powder C' was 3.9%), the charge was $1.80\times10^{-10}$ c/g (an increase of the charge with respect to the powder C' was 61%) and the maximum magnetization was increased with respect to the powder C'.

EXAMPLE 4

Except that $Mn_3O_4$ at a ratio of 27.5 mole % as MnO, 12.5 mole % of CoO and 60 mole % of $Fe_2O_3$ were mixed, the same process as that in Example 1 was carried out to obtain manganese-cobalt ferrite powder D' having the spinel structure. Nickel-cobalt-zinc-ferrite powder E' was obtained through the same process as that in Example 1, except that 10 mole % of NiO 6 mole % of CoO, 4 mole % of ZnO and 80 mole % of $Fe_2O_3$ were mixed.

The powder D' and E' were reduced at 460° C. for 4 hours in the furnace being supplied with propane gas at the rate of 600 liter/hr. The reduced one was pulverized into the primary particles thereby to obtain the magnetic powders D and E.

The oxygen content y in the formula I of the powders D and E were 0.5628 and 0.5137, respectively. The X-ray analysis showed that the powders have the spinel structure and α-Fe. The reflectivity, the charge and the maximum magnetization of each powder were improved over those of the powder D' or E', and were satisfactory.

EXAMPLE 5

A magnetite powder obtained by the wet process commerically available was used as a powder F'. Additionally, a magnetite powder F'' was prepared by the dry process. On preparing the powder F'', α-$Fe_2O_3$ powder as the material was prepared to be slurry and then granules. The granules were sintered at 1380° C. The remaining conditions of the sintering and pulverization were the same as those of the powder A' in Example I.

The powders F' and F'' were subjected to the reduction process as in the Example 2 thereby to obtain the magnetic powders F1 and F2 having y=0.5435 and y=0.5460 in the formula I. The X-ray analysis of those powders F1 and F2 showed the spinel structure and the presence of α-Fe. The increase of the charge and the decrease of the reflectivites of the powders F1 and F2 with respect to F1 and F2 were as shown in Table 2.

TABLE 2

| Powder | Decrease of reflectivity (%) | Increase of charge (%) |
|---|---|---|
| F1 | 7 | 45 |
| F2 | 15 | 53 |

As seen from Table 2, the degree of black and the charge of the powders F1 and F2 were superior to those of the powders F' and F''. The maximum magnetization of the former was improved, compared to the latter.

The magnetic powder and the process for producing it according to the invention are as mentioned above. The magnetic powder according to the invention exhibits a good performance when it is applied for the magnetic toner, the magnetic ink and the ink for an ink jet. The explanation t0 follow is the elaboration of a case where the magnetic toner is applied for the magnetic toner.

The ferrite powders of the present invention and preparations thereof have described in details.

The applications of the ferrite powders of the present invention for magnetic toners or inks will be further illustrated.

Magnetic toners or inks are prepared by blending the magnetic powder of the present invention to a resinous component which can be selected from various thermoplastic resins.

Suitable thermoplastic resins include homopolymers or copolymers derived from one or more monomer such as styrenes, vinylnaphthalene, vinylesters, α-methylene aliphatic monocarboxylic acid esters, acrylonitrile, methacrylonitrile, acrylamide, vinyl ethers, vinyl ketones and N-vinyl compounds or mixtures thereof.

The known resinous components for a magnetic toner or ink can be effectively used. It is preferable to use a resinous component having a glass transition point of about several tens °C., and an average weight molecular weight of about $10^3$ to $10^5$.

In a magnetic toner or ink, it is preferable to incorporate 0.2 to 0.7 wt. part of the magnetic powder of the present invention in 1 wt. part of the resinous component.

In the preparation of the toner or ink, in accordance with the conventional process, the magnetic powder and the resinous component are mixed in a ball mill and the mixture is kneaded by a hot roll and cooled and pulverized and if necessary, the pulverized product is sieved. Thus, a magnetic toner having an average particle diameter of about 5 to 40 is obtained. The magnetic ink can be prepared by incorporating a solvent.

If necessary, a coloring agent such as a pigment and a dye or a charge modifier etc. can be incorporated in the magnetic toner or ink. The magnetic toner or ink can be used for forming an image by a conventional process and a conventional apparatus.

Various tests of magnetic toners prepared by using the ferrite powders of the present invention were carried out to find superiority of these magnetic toners. One example will be described.

Test 2.3 Weight parts of styrene resin and 1 wt. part of modified maleic acid resin and each of the magnetic powders of the present invention were mixed by a ball mill and kneaded, cooled, pulverized, dried and sieved to prepare twelve kinds of toners having an average particle diameter of 15μ.

An electrostatic image was formed on a selenium photosensitive drum and developed by using the resulting toner by the conventional magnetic brush process. The developed image was transferred on a paper and fixed. Excellent results were obtained by using each of the toners. Particularly, the graduation and the resolution of the image were remarkably excellent. The measurements of those by using a graduation chart with 10 steps of reflectivity densities over a range from white to black showed that the respective reflectivity densities of the steps were well reproduced and the resolution of the image was 4 lines/per mm. Excellent images were reproduced by repeating the development and the transferring. When the selenium photosensitive drum was replaced to a zinc oxide photosensitive drum, excellent image was also obtained.

We claim:

1. A magnetic toner or ink which comprises a resinous component and a magnetic powder having the formula $$M_{\frac{1-x}{1+x}(1-y)}Fe_{\frac{2x}{1+x}(1-y)}O_y$$

wherein M represents at least one of Mn, Ni, Co, Mg, Cu, Zn or Cd; and x is in a range of 0.5 to 1 and y is in a range of 0.1 to less than 0.571.

2. A magnetic toner or ink according to claim 1 wherein said magnetic powder is incorporated at a ratio of 0.2 to 0.7 wt. parts to 1 wt. part of said resinous component.

3. A magnetic toner or ink according to claim 1 wherein said resinous component has a weight average molecular weight of $10^3$ to $10^5$.

4. A magnetic toner or ink according to claim 1 wherein said magnetic powder has an average particle diameter of 0.2 to 0.8μ.

5. A magnetic toner or ink according to claim 1 wherein said resinous component is a homopolymer or copolymer of one or more monomers of styrene, vinylnaphthalene, vinyl esters, α-methylene aliphatic monocarboxylic acid esters, acrylonitrile, methacrylonitrile, acrylamide, vinyl ethers, vinyl ketones and N-vinyl compounds.

6. A magnetic toner or ink according to claim 1, wherein said magnetic powder is produced by reducing a corresponding ferrite powder or iron oxide powder in a reducing atmosphere at a temperature lower than 600° C. and combining said magnetic powder with a resinous component.

7. A magnetic toner or ink according to claim 1, wherein the value of x ranges from 0.5 to 0.98.

8. A magnetic toner or ink which comprises a resinous component and a magnetic powder having the formula $$M_{\frac{1-x}{1+x}(1-y)}Fe_{\frac{2x}{1+x}(1-y)}O_y$$

wherein M represents at least one of Mn, Ni, Co, Mg, Cu, Zn or Cd; and x is in a range of 0.5 to 1 and y is in a range of 0.3572 to 0.5540.

* * * * *